US007007584B2

(12) United States Patent
Caballer Barat

(10) Patent No.: US 7,007,584 B2
(45) Date of Patent: Mar. 7, 2006

(54) SECURING SYSTEM FOR PYROTECHNIC LAUNCH TUBES

(75) Inventor: Vicente Caballer Barat, Liria (ES)

(73) Assignee: Pirotecnia Caballer, S.A., (ES)

( * ) Notice: Subject to any disclaimer, the term of this patent is extended or adjusted under 35 U.S.C. 154(b) by 0 days.

(21) Appl. No.: 10/504,183

(22) PCT Filed: Feb. 10, 2003

(86) PCT No.: PCT/ES03/00072

§ 371 (c)(1),
(2), (4) Date: Aug. 11, 2004

(87) PCT Pub. No.: WO03/069259

PCT Pub. Date: Aug. 21, 2003

(65) Prior Publication Data

US 2005/0204911 A1 Sep. 22, 2005

(30) Foreign Application Priority Data

Feb. 14, 2002 (ES) ..... P200200360

(51) Int. Cl.
*F41F 3/04* (2006.01)

(52) U.S. Cl. ..... 89/1.816; 102/343; 102/356; 102/358

(58) Field of Classification Search ..... 102/335, 102/341, 343, 345, 356, 358, 360; 89/1.816
See application file for complete search history.

(56) References Cited

U.S. PATENT DOCUMENTS

| | | | | |
|---|---|---|---|---|
| 4,222,306 A | | 9/1980 | Maury | |
| 5,339,741 A | * | 8/1994 | Craven et al. | 102/361 |
| 5,429,053 A | | 7/1995 | Walker | |
| 5,739,462 A | * | 4/1998 | Poor et al. | 102/342 |
| 6,393,990 B1 | * | 5/2002 | Fagan | 102/342 |
| 6,508,178 B1 | * | 1/2003 | Shelton | 102/349 |
| 6,779,459 B1 | * | 8/2004 | Werner | 102/349 |
| 2005/0092622 A1 | * | 5/2005 | Whitley | 206/3 |

FOREIGN PATENT DOCUMENTS

| | | |
|---|---|---|
| ES | 2 147 692 | 9/2000 |
| FR | 1 549 477 | 12/1968 |
| FR | 2 715 998 | 8/1995 |

OTHER PUBLICATIONS

International Search Report dated May 12, 2003.

* cited by examiner

*Primary Examiner*—J. Woodrow Eldred
(74) *Attorney, Agent, or Firm*—Ostrolenk, Faber, Gerb & Soffen, LLP

(57) ABSTRACT

Based on pyrotechnic launch tubes (1) with a cylindrical body which houses in their interior both the pyrotechnic objects or materials (3) and the lifting powder (5), the system consists in providing each cylinder (1), on its lower base, with a series of tabs (6), determining a radially deformable neck, wherein said tabs (6) are finished in barbs (7) for engagement by pressure in a securing piece (11–11'), fastenable to the frame of the tubes or incorporated by way of a single piece in the actual frame, provided with an external and rigid neck with a gradation (14) for the engagement of the barbs (7) and provided with an axial and cylindrical core (10) which, perforating the bottom of the cylinder (1), is of a size to house in its interior the igniter (12) with its corresponding cable (13), which is thereby perfectly protected from possible environmental humidity.

12 Claims, 8 Drawing Sheets

SECURING SYSTEM FOR PYROTECHNIC LAUNCH TUBES

OBJECT OF THE INVENTION

The present invention relates to a new system for securing a plurality of pyrotechnic launch tubes to the corresponding frame, which system allows a broad range of possibilities, practically limitless, as to the relative positioning between each launch tube and the frame which supports them, a system whereby a perfect seal is also assured in the connections, up to the point where it is applicable also in aquatic firework displays.

BACKGROUND OF THE INVENTION

With the purpose of assisting in the understanding of the present specification and given the special terminology used in some of the different earlier registrations that are cited below, it is considered specially relevant to clarify the following concepts:

Conventionally and in general terms, a "case" is a pyrotechnic device which is structured by means of a cylindrical or spherical plastic or cardboard chamber which contains a propellant charge which by means of an ignition conduit such as a cap or wick or even an electric match, produces gases whose thrust, channelled by a "mortar" or battery of mortars, propels the case upwards. The delay in the transmission of the ignition, started by the propellant charge, burns during the ascent of the case and fires the explosive charge when the case reaches its highest point, causing the bursting open of the chamber, propelling and lighting the pyrotechnic materials which will create the desired effect.

These "cases" can be of different types, namely, unitary or repeating in which case they will be constituted by several superimposed chambers connected pyrotechnically for retarded ignition and arranged inside the "mortars" by the actual firework specialist.

Conventionally, a "candle" is understood to be the device formed by a cylindrical tube, generally of cardboard or plastic which fires one or several pyrotechnic objects or materials housed in its interior, these being of any kind, like volcano type, stars, groups of cartridges, etc., in any of their forms, which with the collaboration of an intermediate screen remain separate from the lifting powder (there being as many as there are pyrotechnic objects), this tube being closed at its upper end by means of a cover, with the respective ignition wick, it being possible to secure for example the cylindrical tube to a frame or even a support which allows it to be maintained, the tube of the candle forming part of the device itself.

Conventionally a "mortar" is understood to be a tube which serves to project cases, for which reason it constitutes a piece independent of the device.

In accordance with that set out in Articles 22 and 10 of the Regulations on Explosives, according to Order in Council 230/1998 of February 16, the following should be understood to be pyrotechnic devices, units and materials:

Art. 22.—The consideration of pyrotechnic devices shall be given to the artefacts or devices charged with pyrotechnic materials or mixtures, generally deflagrating, as defined in Art. 10.

Art. 10 para. b) Pyrotechnic materials: Materials or mixtures of materials intended to achieve a heat-, light-, sound-, gas- or smoke-producing effect, or a combination of these effects, as a consequence of non-detonating self-sustaining exothermic chemical reactions.

Art. 10 para. d) Pyrotechnic objects: Objects that contain one or several pyrotechnic materials.

In the Spanish utility model with application number U9203065, a device is disclosed for the multiple shooting of pyrotechnic cases, the launch tube being identified as a "case" when in accordance with the foregoing it should be identified as a "mortar", wherein the frame mentioned is materialized in a supporting platform, provided on its surface with at least one groove which follows its outline, for the fitting and securing of an ignition wick, as well as a series of grooves or recesses for the vertical fitting of a plurality of "mortars" which are arranged on the platform over the ignition wick, which, appropriately perforated in the area of ignition of the cases arranged inside the mortars, transmits fire successively to each of them which will produce the shot.

The fundamental problem of this device rests in the fact that since the mortars are simply coupled to the platform through the aforementioned recesses, their stability proves very precarious and the battery is only functionally safe when said platform adopts in turn a perfectly horizontal position, which is not desirable on occasions for the artistic or aesthetic effect of the show, particularly when it is sought to have the pyrotechnic device ascend in an inclined path to adopt fan-like configurations.

The lack of stability of the aforementioned utility model is resolved with the solution disclosed in the Spanish patent of invention with application number 009702141, consisting of a battery of mortars for fireworks, in which said mortars are appropriately secured between two bases, one below with housings for the lower extremity of the mortars, and another above with holes for coupling to the mouth of the latter, both bases being connected to each other by means of a series of spacer struts which, securing them adequately, permit their easy dismantling for replacement of the mortars.

An equivalent solution is that disclosed in the Spanish patent of invention with application number 009802205, in which the different mortars participating in the battery together constitute a single piece, joined specifically through a lower and single base, common to them all, and connected by means of thickened areas in their side wall which establish continuity for the same, at least over a wide lower sector of said mortars, a solution with which an adequate stability is clearly also achieved for each of the mortars which form the battery, but as in the previous case it has the fundamental problem of the rigidity of the system, which does not allow each of the mortars to be pointed independently, to achieve divergent trajectories, at variable angles.

Moreover the cylindrical tubes which constitute the mortars are in most cases closed at the bottom, so that for the ignition of the pyrotechnic objects or materials housed in their interior conventional wicks are used located in some cases in the upper part of the mortar and in other cases in the sides of the same, at any height, which makes it possible for the actual wick to become damp through being in contact with the weather, either retarding the corresponding shot and losing control of its synchronization, or impeding the actual shot.

In other cases, like that of the first mentioned utility model, the wick runs between the base of the mortars and the platform which supports it, for which a small contact orifice is provided, the firing of each mortar being done according to the actual course of the wick, with no possibility of controlled firing and without the precision required to please the firework expert. In these cases, the rate of fire between each of the mortars is determined by the course of the wick between their respective orifices, the firing being limited to some standard speeds which are determined by the wick itself, and the control, precision and setting of different times of firing at the criterion of the expert is not possible.

Likewise, it is necessary to bear in mind that on occasions the arrangement of the wick as disclosed in the aforementioned Utility Model, is such that in the event of a faulty contact between the same and the lifting powder the conflagration of the latter is impeded making firing impossible.

The present invention also resolves the aforementioned problem and guarantees in a greater measure the solution of problems relative to the control, precision and execution of firing, as well as the establishment of firing times according to the criteria of the expert by means of electric matches, as well as its airtightness.

In the light of the foregoing, the invention disclosed overcomes the drawbacks in what has been termed "launch tubes" with the purpose of combining both the tubes which form an integral part of the "candles" and those which constitute the actual "mortars".

DESCRIPTION OF THE INVENTION

The securing system for pyrotechnic launch tubes which the invention discloses resolves in a fully satisfactory manner the problems outlined above and to this end the tube which forms part of the candle or the tube which constitutes the mortar has on its lower base, that for coupling to the pertinent frame, a series of elastically deformable tabs, included in an imaginary cylindrical and coaxial plane to the actual body, finished at their free ends in respective barbs, so that said tabs configure radially a kind of deformable neck, for coupling the tube by pressure in an independent securing piece for its later fitting to the frame, or in the event to a securing piece adequately joined to the latter.

This cylindrical neck determines in turn an axial coupling for an igniter, whereby this latter is properly located inside the deformable neck and the frame in which the latter is fixed, protecting it properly against the effects of environmental humidity.

As has already been said stated, the radially deformable neck with which the lower end of the tube is provided will be able to adapt to securing piece independent of or even joined to the frame itself.

Likewise, the characteristics of the actual invention allow the possibility of forming in a single monobloc piece, the assembly formed by the actual launch tube and the securing piece, for their later fitting in the frame, in which case the presence is not necessary of the deformable tabs.

In either of the cases, the frame will have as many holes as tubes foreseen for installation on the same, receivers of the respective securing pieces in any one of the aforementioned configurations, indeed the frame will have conventional securing means for any type of support, forming any angle or inclination with said frame, even with rectilinear or curved profiles, these pieces being complementary which in turn will receive the tubes which will therefore be able to adopt any relative position and any direction within the general context of the battery while permitting its support in a safe manner and guarantee the airtightness of the electric matches.

DESCRIPTION OF THE DRAWINGS

To complete the description that is being made and with the object of assisting in a better understanding of the characteristics of the invention, in accordance with a preferred example of practical embodiment thereof, this description is accompanied with, as an integral part thereof, a set of drawings wherein, by way of illustration and not restrictively, the following has been represented.

PREFERRED EMBODIMENT OF THE INVENTION

Figure 1:
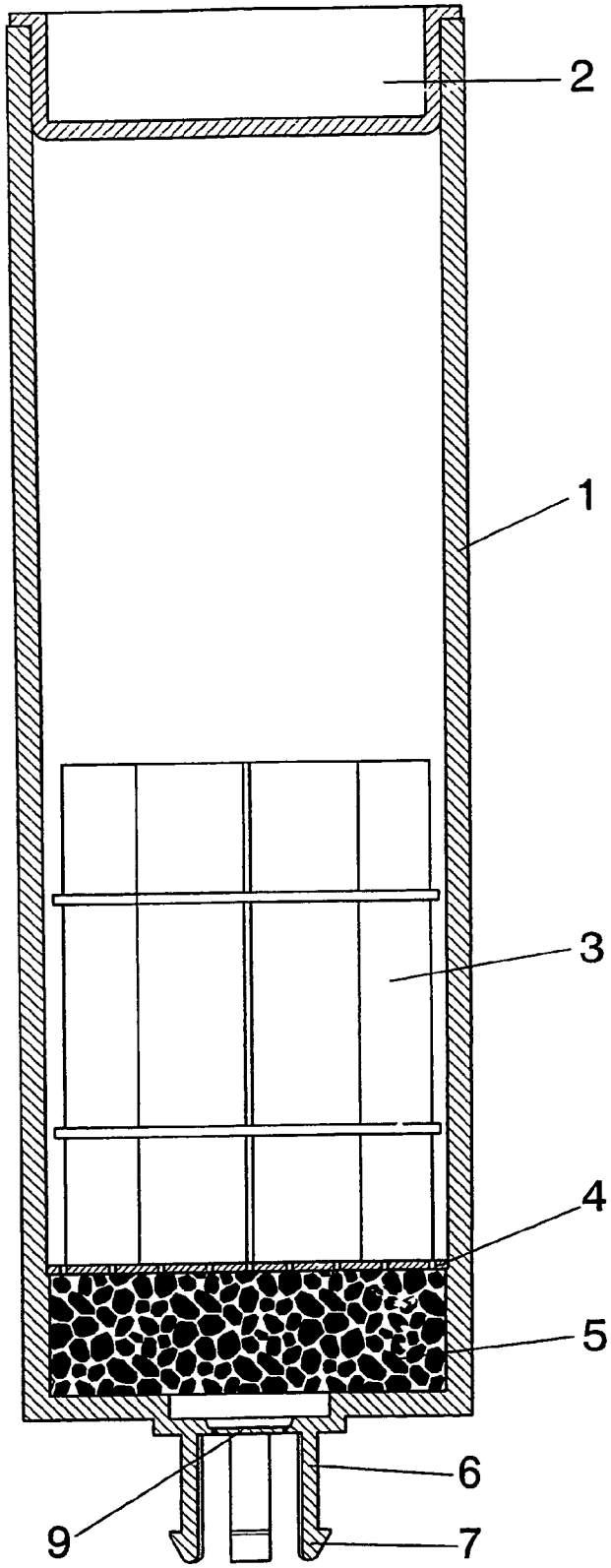
FIG. 1.—It shows a schematic representation in side elevation and in cross section of a tube provided with a securing system which constitutes the object of the present invention.

As has been indicated above in the background of the invention and making use of FIG. 1 as guidance, the candles conventionally employed in pyrotechnic batteries, are structured on the basis of a cylindrical tube (1) which is closed at the top by means of a cover (2), which houses in its interior the pyrotechnic objects or materials (3) separated by a grill (4) from the lifting powder (5) necessary for the pyrotechnic objects or materials (3) to rise to the region foreseen for their explosion. To perform the ignition of the candle there is the corresponding wick.

In the same way, and as has been indicated above, the conventional mortars consist of some cylindrical tubes (1) in the interior of which the corresponding case is placed for the propulsion thereof, having likewise the pertinent igniting wick.

Figure 3:
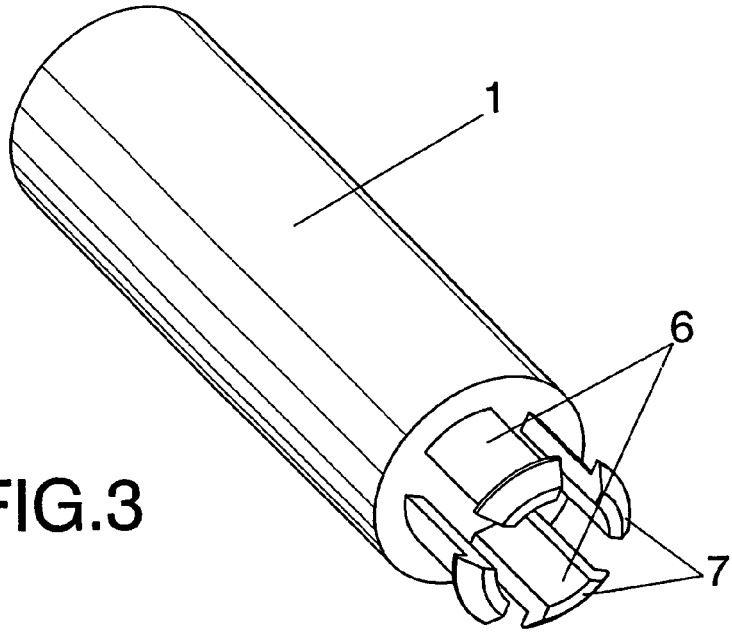
FIG. 3.—It shows a detail in external perspective of the tube represented in FIG. 1.

So, starting from these basic and conventional structures, the cylindrical tubes (1) disclosed and which form part of the candles or which constitute the mortars, incorporate in their lower base a plurality of elastically deformable tabs (6), preferably four in number, equiangularly distributed on the periphery of a cylindrical surface coaxial with the actual body (1) and finished at their free ends in individual barbs (7), configuring a kind of radially deformable neck, specially visible in FIG. 3, which can be secured by fitting with direct or indirect pressure in the frame (8), which supports the different launch tubes (1), as will be seen later.

Figure 2:
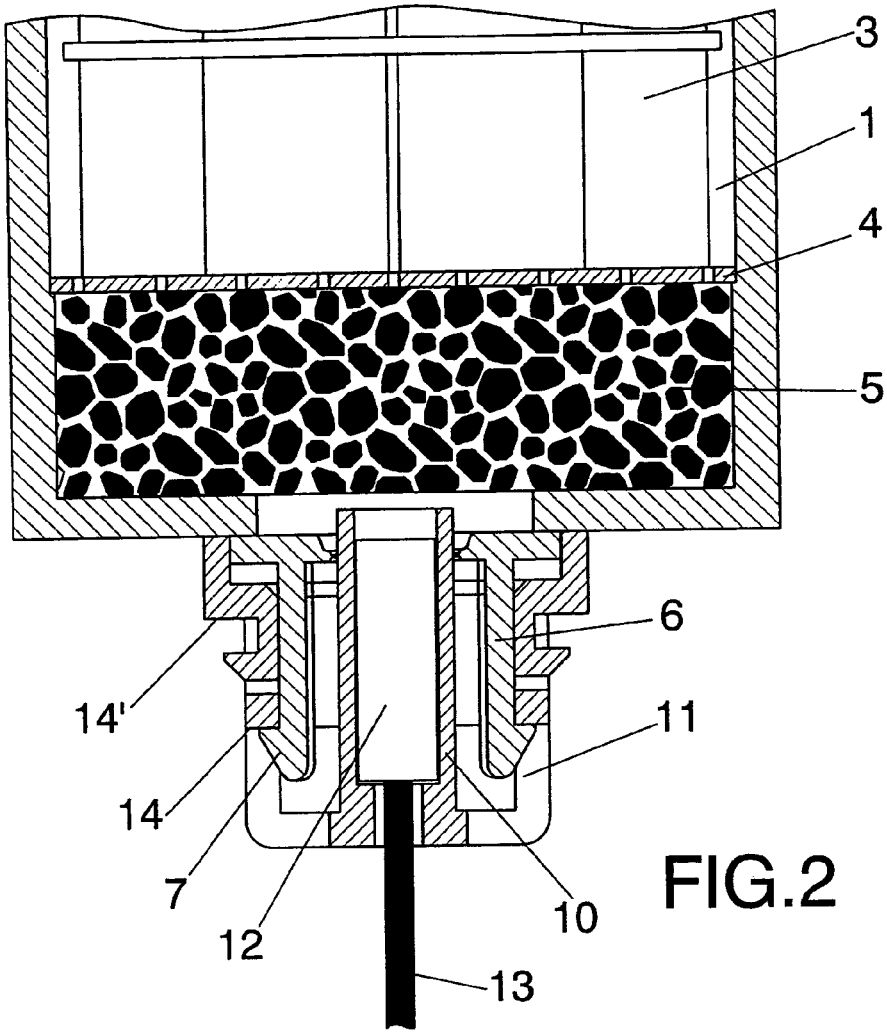
FIG. 2.—It shows an enlarged detail of the previous figure, at the level of the lower end of the tube which appears coupled to the piece for securing to the frame, the latter not being represented in the drawing.
Figure 4:
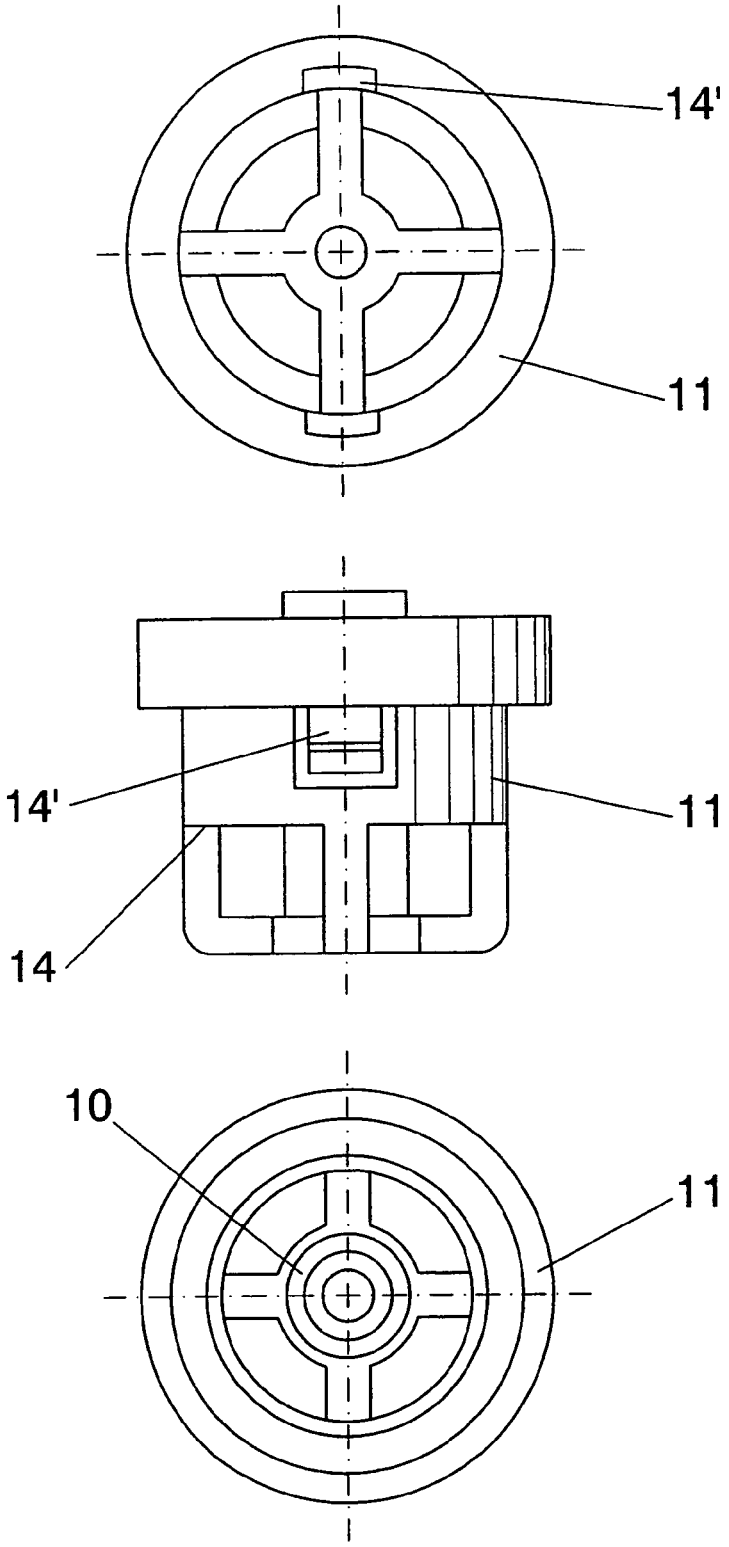
FIG. 4.—It shows a view in side elevation and two axial and opposing views of the supplementary securing piece of each of the tubes, in the event of this being independent.
Figure 5:
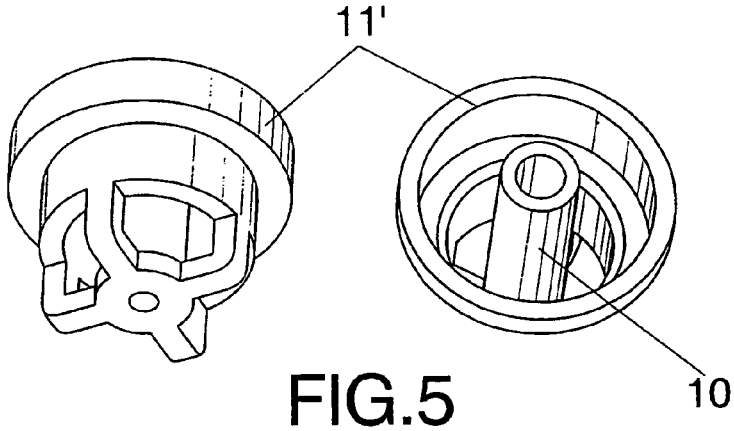
FIG. 5.—It shows two views in perspective, opposing, of the securing piece of FIG. 4, for the case in which this takes a single piece form in the actual frame, the latter not being represented in the drawing.
Figure 6:
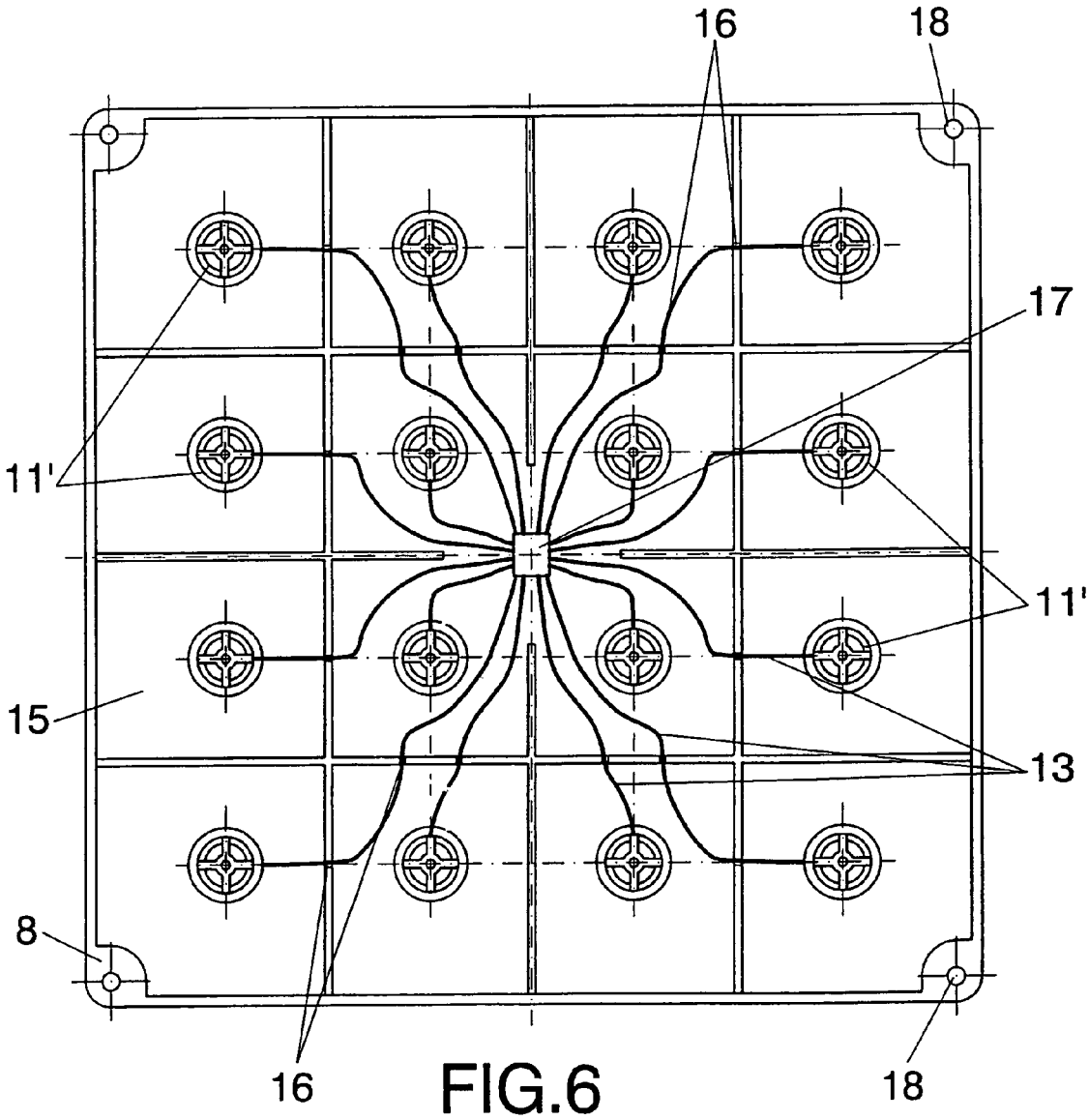
FIG. 6.—It shows a bottom plan detail of a frame provided with a plurality of securing pieces for respective tubes.
Figure 7:
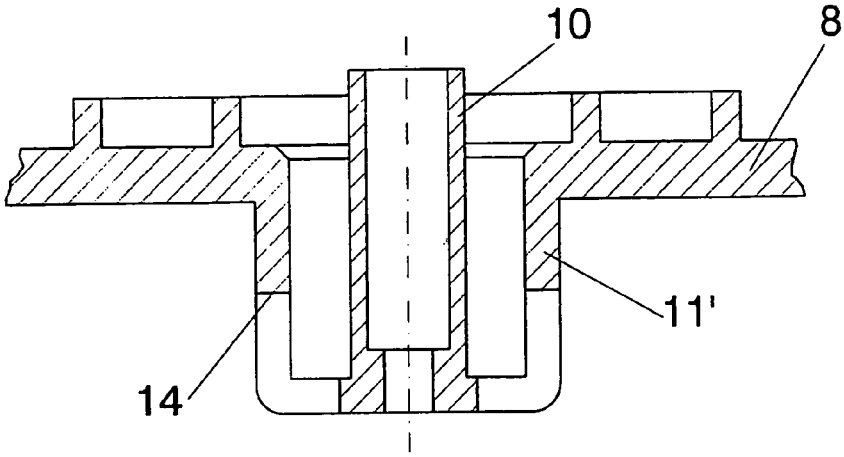
FIG. 7.—It shows a detail in profile and in cross section of the securing piece shown in FIG. 5, at the level of one of the frames.

The lower base of the cylindrical tube (1), initially closed, incorporates in its middle area, that corresponding to the radially deformable neck (6), a weakened bottom (9), easily ruptured, which allows access to the interior of the cylindrical tube (1) of the axial area (10) of a securing piece (11), which can constitute a piece physically independent of the frame (8), having the gradations (14') for its securing to the latter, as has been represented in FIGS. 2 and 4, or which can be incorporated in the actual frame (8), as has been represented in FIGS. 6 and 7, wherein each portion of the frame (8) corresponding to the securing of a cylindrical tube (1) has been referred to with (11'), in which case the gradations (14') for securing are not necessary, as has been represented in FIG. 5.

In whatever case, the axial area (10), cylindrical, is appropriately sized to house in its interior the igniter (12), which thereby is kept perfectly isolated from the environmental agents, especially from humidity, the connection cable (13) emerging from the underside thereof, which cable is likewise kept perfectly isolated over an extensive initial length.

Both if the securing piece (11) is physically independent of the frame (8), as has been represented in FIG. 2, and if said securing piece (11') is incorporated by way of a single piece in the frame (8) mentioned, as has been represented in FIG. 7, it will incorporate in any case, as well as the axial core (10) for housing the igniter, an annular and external body provided with gradations (14) for joining and retaining the corresponding cylindrical tube (1) through the barbs (7) of its radial and elastically deformable neck.

Figure 12:
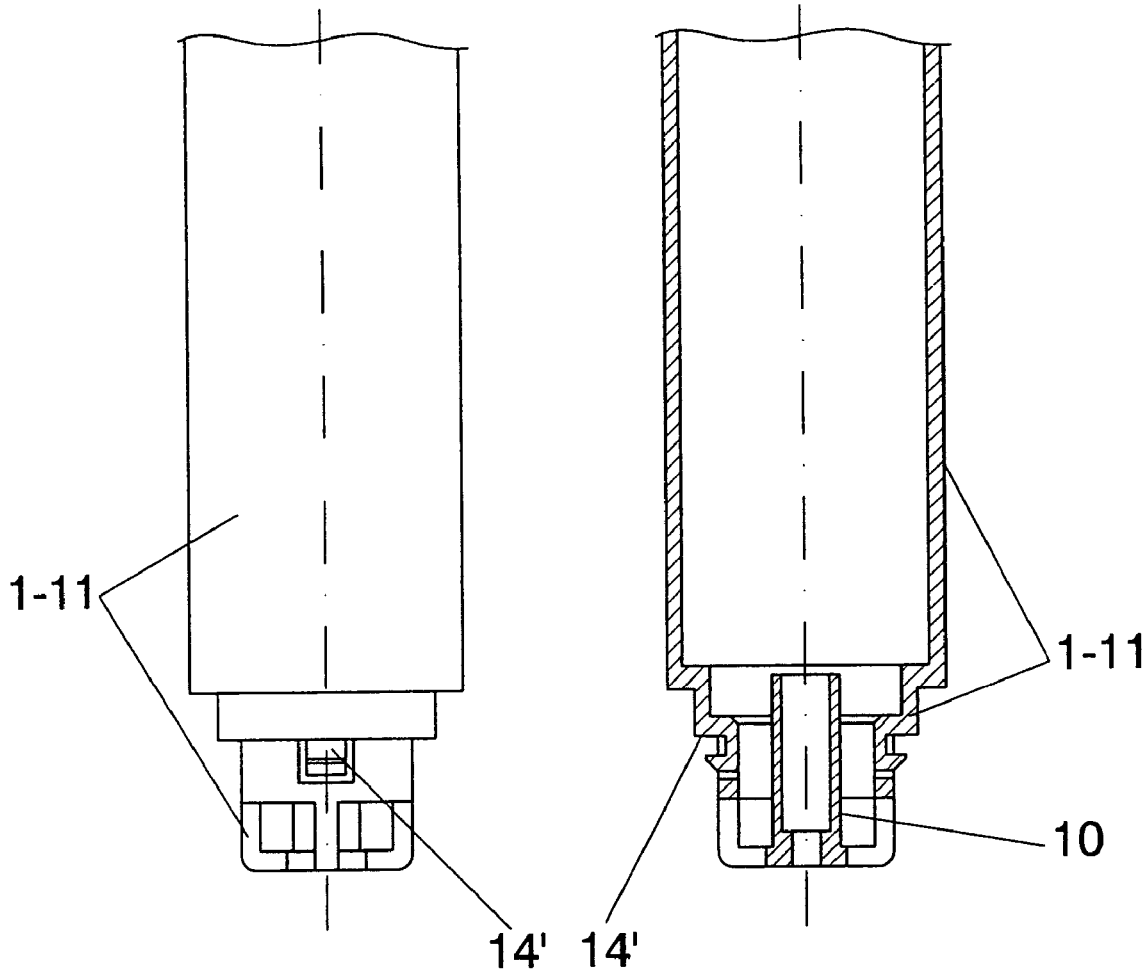
FIG. 12.—It shows a schematic representation in elevation and in cross section of a tube formed by way of a single piece with the piece for securing to the frame, the latter not being represented in the drawing.

Likewise, and as has been represented in FIG. 12, there exists the possibility of forming in a single monobloc piece the assembly formed by the actual launch tube (1) and securing piece (11), in which case the presence of the deformable tabs (6) will not be necessary, so that the fitting of the monobloc piece (1–11) through the gradations (14') in whatever of the frames (8–8') will likewise guarantee the support of the launch tubes, with different inclinations and directions as well as the airtightness of the electric igniter (12) by being housed in the axial core (10).

Also in anyone of the previous cases, the arrangement of the cylindrical tubes (1) will be variable according to the criterion of the designer of the frame (8), which will preferably have areas (15) in numeric and positional correspondence with the cylindrical tubes (1), communicated by means of grooves (16) for passage of the power cables (13) for said tubes (1), up to a point (17) for their fitting to an electrical connector, with their corresponding electric and electronic elements, through which the opportune instructions can be given by remote control for ignition of the different cylindrical tubes (1).

The frame (8) will have conventional means (18), for example located in correspondence with its corners, for its securing to any appropriate support and also with any appropriate position, be it horizontal or inclined.

Figure 8:
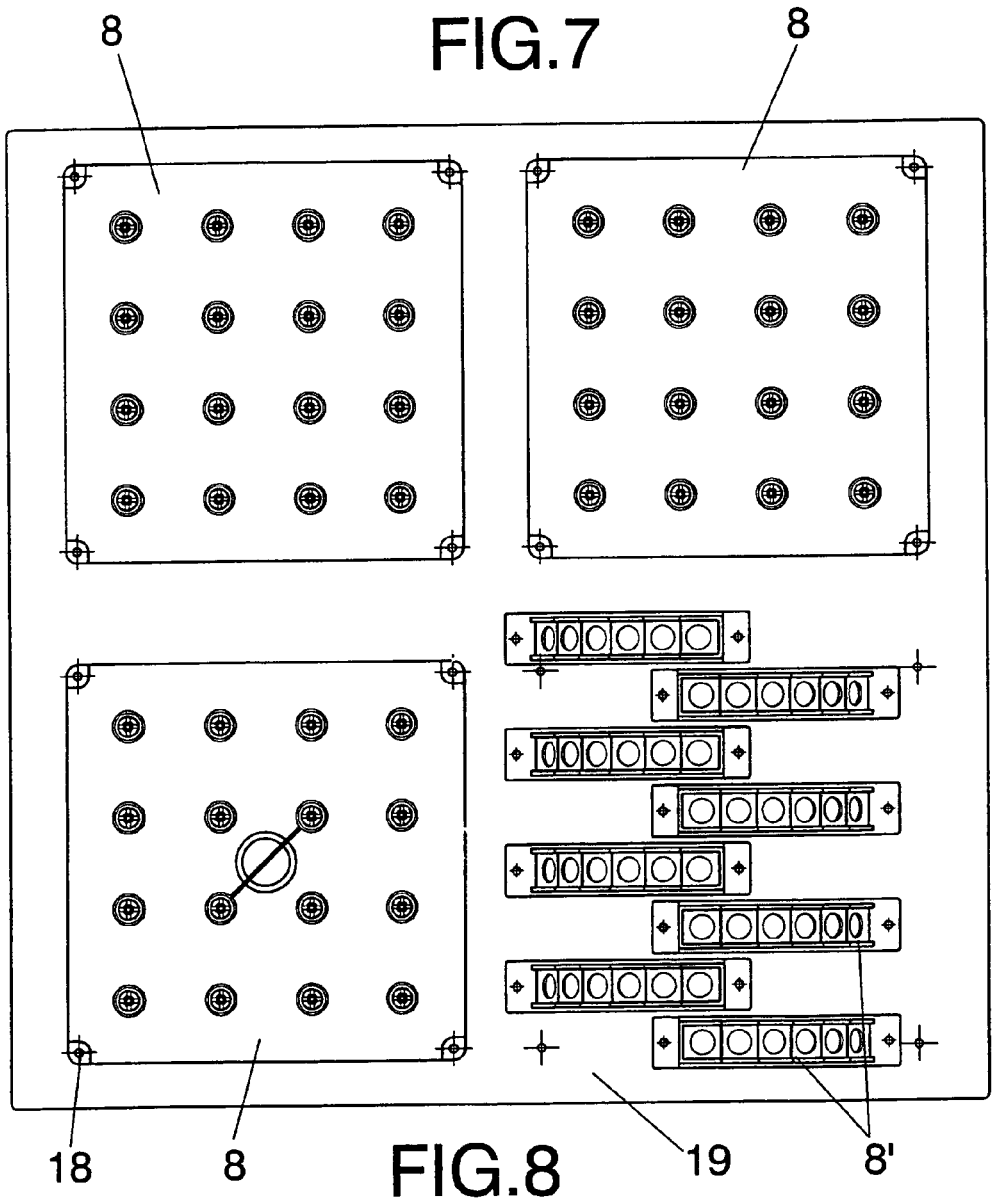
FIG. 8.—It shows, according to a schematic representation in plan view, a support foreseen to receive a series of frames which allow different assemblies for the tubes.
Figure 9:
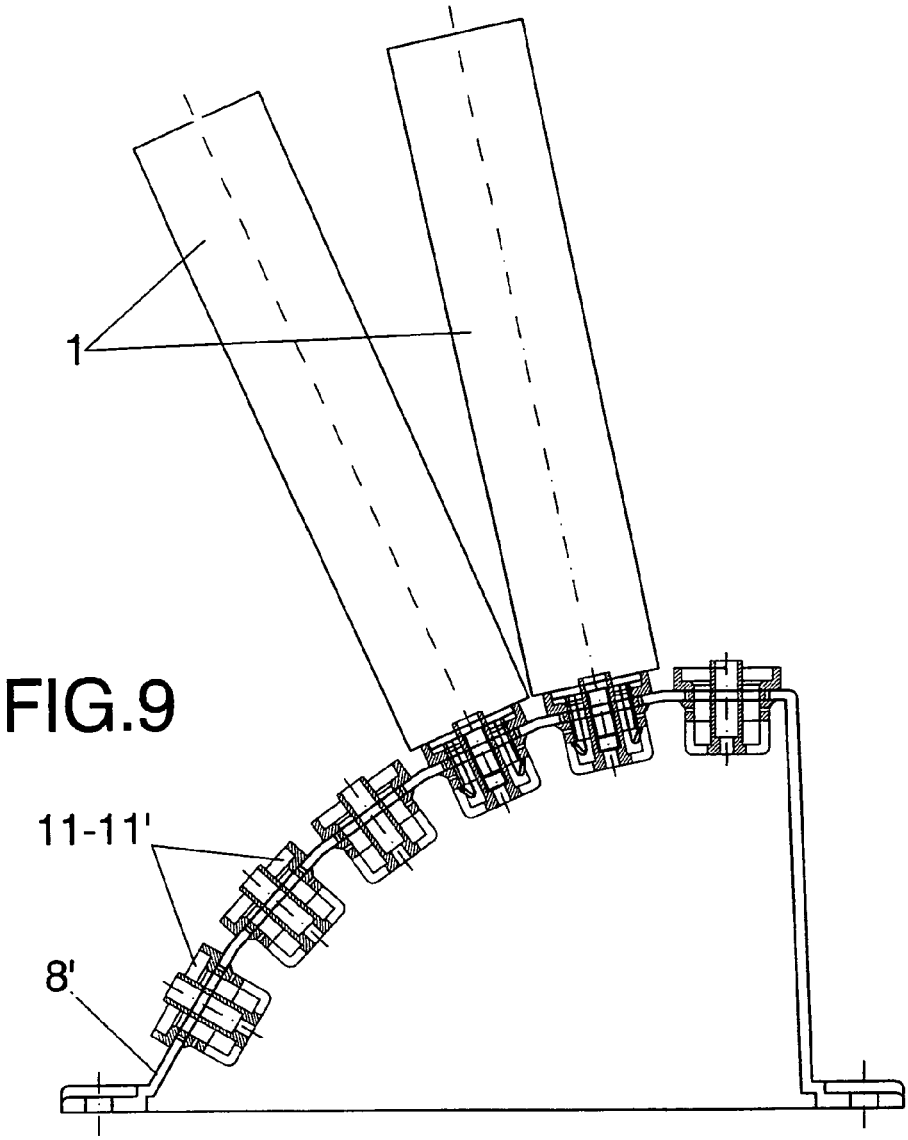
FIG. 9.—It shows a detail in profile of the assembly represented in FIG. 8, specifically at the level of an area in which an arrangement has been foreseen for the tubes in fan formation.
Figure 10:
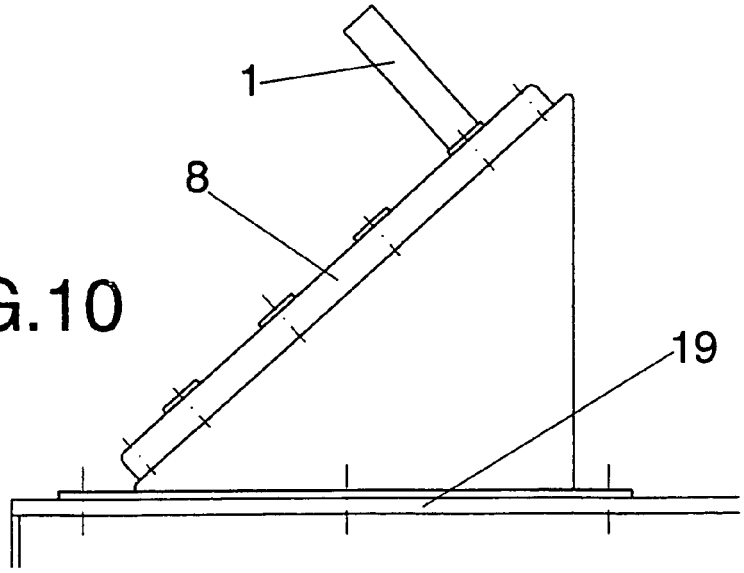
FIG. 10.—It shows a similar representation to that of FIG. 9, but in which a substantially inclined arrangement of the frame has been foreseen, with the respective tubes parallel to each other.

Specifically in FIG. 8 a support (19) is shown on which are mounted by way of example three quadrangular frames (8), with a reticular and likewise quadrangular distribution for the different tubes (1), and a grouping of lineal frames (8'), so that the frames (8) can even adopt an inclined position like that shown in FIG. 10, whilst the lineal frames (8') describe an arched, convexly curved course, wherein the alignment of securing pieces (11) or (11') gives rise to a fanlike assembly for the tubes (1) which thereby result of variable inclination, growing progressively from one ends of the frame (8') to the other, as is perfectly observed in FIG. 9.

Figure 11:
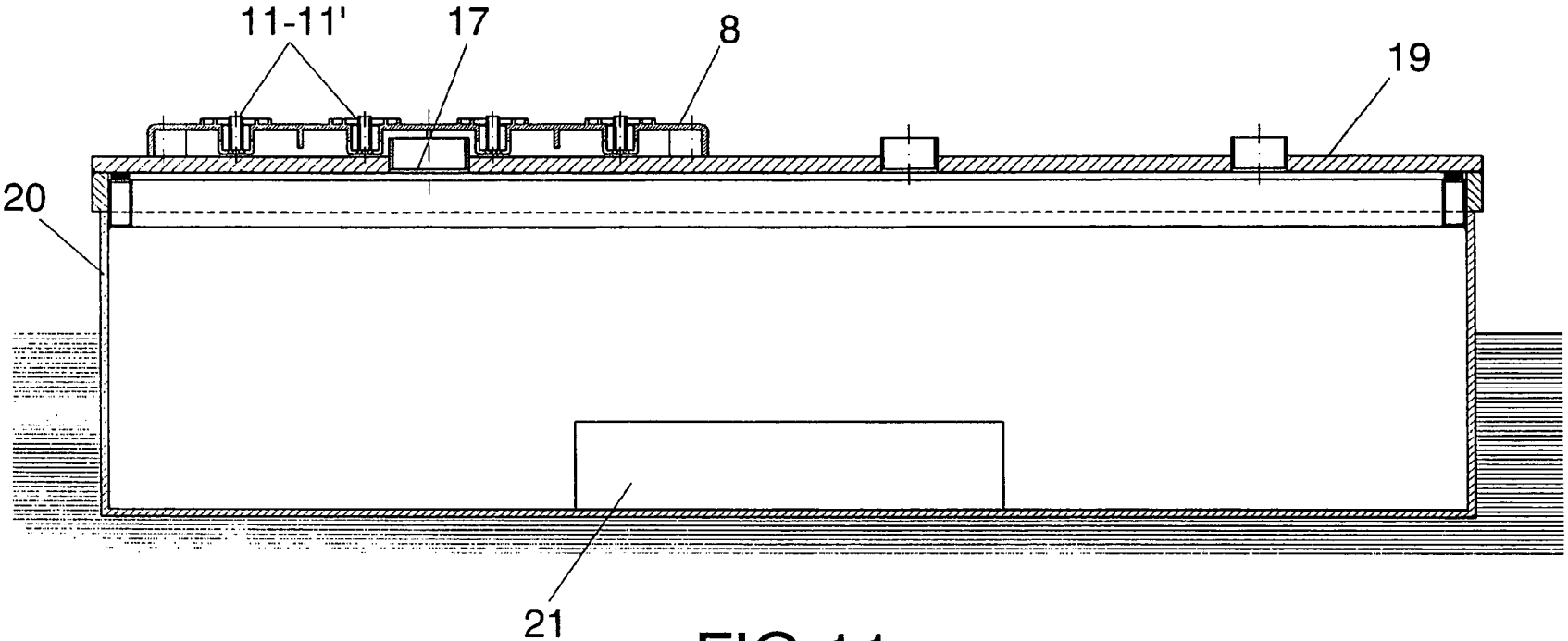
FIG. 11.—It shows, finally, a variant of practical embodiment of the floating bucket or bin, also according to a schematic representation in side elevation, foreseen for aquatic fireworks.

Finally and as shown in FIG. 11, the support (19) can be prepared, on which the frames are mounted (8–8') with the previously mentioned securing pieces (11–11'), which support (19) constitutes the cover closing a floating bucket or bin (20), watertight, intended to constitute a raft, for aquatic firework batteries, the cables converging in a watertight form in the point of common contact (17), from which they are led to a connection box (21) for remote control of the battery.

What is claimed is:

1. A system for securing pyrotechnic launch tubes to a frame, wherein at least one said launch tube comprises a cylindrical body (1), said body including, at a lower extremity, a plurality of tabs (6), which, taken together, form a cylindrical, radial and elastically deformable neck, in which the tabs are provided with respective barbs (7), said barbs adapted for locking a respective launch tube to a securing piece (11–11'), wherein the securing piece may be attached to the frame (8) or integrally incorporated with the frame as a single piece.

2. The system according to claim 1, wherein the securing piece (11–11') comprises a tubular and cylindrical axial portion (10), capable of perforating a weakened bottom portion (9) of the cylindrical body (1) of at least one said launch tube and of housing in its interior an igniter (12), and a corresponding power cable (13) which is thereby protected from the weather, the cylindrical body (1) being coaxial with the neck, wherein, located outwardly of said neck and attached to the securing piece (11–11'), is a substantially rigid neck provided with a peripheral gradation (14) adapted to permit engagement by the barbs (7) on said tabs (6).

3. The system according to claim 2, wherein the securing piece (11–11') is adapted for forming, together with the cylindrical body (1), a unitary body configured and adapted to fit in the frame (8–8'), said system further adapted to permit housing in an axial portion (10) thereof an igniter (12), with its corresponding power cable (13), so as to protect the igniter and power cable from weather effects.

4. The system according to claim 1, wherein the frame (8) adapted for receiving the tubes is provided with means (18) for securing one or more of said pyrotechnic launch tubes, and wherein the frame (8) can adopt a horizontal or inclined position, with any degree of inclination, including an arched trajectory, which permits positioning of the tubes in a fan arrangement with a degree of inclination which is variable and which grows progressively from one end of the frame (8') to the other.

5. The system according to claim 1, further comprising a support (19) which, together with the frame (8–8') and with the corresponding securing pieces (11–11'), is capable of constituting a cover having a watertight seal comprised of a bucket or bin (20), wherein the resultant structure can serve as a raft, afloat in a body of water, for uses as an aquatic pyrotechnic battery.

6. The system according to claim 2, wherein the frame (8) adapted for receiving the tubes is provided with means (18) for securing one or more of said pyrotechnic launch tubes, and wherein the frame (8) can adopt a horizontal or inclined position, with any degree of inclination, including an arched trajectory, which permits positioning of the tubes in a fan arrangement with a degree of inclination which is variable and which grows progressively from one end of the frame (8') to the other.

7. The system according to claim 3, wherein the frame (8) adapted for receiving the tubes is provided with means (18) for securing one or more of said pyrotechnic launch tubes, and wherein the frame (8) can adopt a horizontal or inclined position, with any degree of inclination, including an arched trajectory, which permits positioning of the tubes in a fan arrangement with a degree of inclination which is variable and which grows progressively from one end of the frame (8') to the other.

8. The system according to claim 2, further comprising a support (19) which, together with the frame (8–8') and with the corresponding securing pieces (11–11'), is capable of constituting a cover having a watertight seal comprised of a bucket or bin (20), wherein the resultant structure can serve as a raft, afloat in a body of water, for use as an aquatic pyrotechnic battery.

9. The system according to claim 3, further comprising a support (19) which, together with the frame (8–8') and with the corresponding securing pieces (11–11'), is capable of constituting a cover having a watertight seal comprised of a bucket or bin (20), wherein the resultant structure can serve as a raft, afloat in a body of water, for use as an aquatic pyrotechnic battery.

10. The system according to claim 4, further comprising a support (19) which, together with the frame (8–8') and with the corresponding securing pieces (11–11'), is capable of constituting a cover having a watertight seal comprised of a bucket or bin (20), wherein the resultant structure can serve as a raft, afloat in a body of water, for use as an aquatic pyrotechnic battery.

11. The system according to claim 6, further comprising a support (19) which, together with the frame (8–8') and with the corresponding securing pieces (11–11'), is capable of constituting a cover having a watertight seal comprised of a bucket or bin (20), wherein the resultant structure can serve as a raft, afloat in a body of water, for use as an aquatic pyrotechnic battery.

12. The system according to claim 7, further comprising a support (19) which, together with the frame (8–8') and with the corresponding securing pieces (11–11'), is capable of constituting a cover having a watertight seal comprised of a bucket or bin (20), wherein the resultant structure can serve as a raft, afloat in a body of water, for use as an aquatic pyrotechnic battery.

* * * * *